US011448448B2

(12) United States Patent
Zitting et al.

(10) Patent No.: US 11,448,448 B2
(45) Date of Patent: Sep. 20, 2022

(54) ICE BAGGING AND DISPENSING APPARATUS

(71) Applicant: Pure Water Technologies 1, LLC, Salt Lake City, UT (US)

(72) Inventors: Robert Zitting, Salt Lake City, UT (US); Lorin K. Zitting, Colorado City, AZ (US); Lorin B. Zitting, St. George, UT (US)

(73) Assignee: Pure Water Technologies #1, LLC, Salt Lake City, UT (US)

( * ) Notice: Subject to any disclaimer, the term of this patent is extended or adjusted under 35 U.S.C. 154(b) by 19 days.

(21) Appl. No.: 16/226,545

(22) Filed: Dec. 19, 2018

(65) Prior Publication Data

US 2019/0186802 A1 Jun. 20, 2019

Related U.S. Application Data

(60) Provisional application No. 62/607,804, filed on Dec. 19, 2017.

(51) Int. Cl.

| | |
|---|---|
| ***F25C 5/20*** | (2018.01) |
| ***F25C 5/182*** | (2018.01) |
| ***B65B 43/52*** | (2006.01) |
| ***B65B 51/10*** | (2006.01) |
| ***A47F 1/00*** | (2006.01) |
| ***B65B 25/00*** | (2006.01) |

(Continued)

(52) U.S. Cl.

CPC ..... *F25C 5/24* (2018.01); *A47F 1/00* (2013.01); *B65B 25/00* (2013.01); *B65B 43/52* (2013.01); *B65B 51/10* (2013.01); *F25C 5/182* (2013.01); *F25C 5/20* (2018.01); *B65B 43/123* (2013.01); *B65B 43/267* (2013.01); *B65B 43/30* (2013.01); *B65B 51/146* (2013.01); *F25D 2331/801* (2013.01)

(58) Field of Classification Search

CPC .... F25C 5/24; F25C 5/20; F25C 5/182; A47F 1/00; A47F 3/02; B65B 25/00; B65B 51/10; B65B 43/52; B65B 43/30; B65B 43/267; B65B 43/123; B65B 51/146; F25D 2331/801

USPC ..... 62/344

See application file for complete search history.

(56) References Cited

U.S. PATENT DOCUMENTS 1,871,000 A * 8/1932 Klostermann ..... G07F 11/24 221/277

2,234,051 A * 3/1941 Lakso ..... B31B 70/00 493/224

(Continued)

*Primary Examiner* — Eric S Ruppert

*Assistant Examiner* — Kirstin U Oswald

(74) *Attorney, Agent, or Firm* — Gurr Brande & Spendlove, PLLC; Robert A. Gurr

(57) ABSTRACT

An ice bagging and dispensing apparatus has at least one ice making machine; an ice hopper for receiving ice from the at least one ice making machine; an ice bagging machine for bagging ice from the ice hopper; an ice bag conveyor for conveying bagged ice from the ice bagging machine to an ice storage chamber, the ice bag conveyor positioned below the ice storage chamber; a carriage for moving and lifting the bag of ice into the ice storage chamber; one or more supports for supporting one or more bags of ice in the ice storage chamber above the ice bag conveyor; and, one or more consumer access doors to the ice storage chamber. This maintains first-in, first out (FIFO) principles.

2 Claims, 11 Drawing Sheets

(51) Int. Cl.

| | |
|---|---|
| *B65B 43/30* | (2006.01) |
| *B65B 43/26* | (2006.01) |
| *B65B 43/12* | (2006.01) |
| *B65B 51/14* | (2006.01) |

(56) References Cited

U.S. PATENT DOCUMENTS 2,280,810 A * 4/1942 Eddy ..... G07F 11/14 221/232
2,889,671 A * 6/1959 Weisman ..... B65B 9/023 53/554
3,151,668 A * 10/1964 Zimmermann ..... G07F 11/68 206/390
3,542,244 A * 11/1970 Dyer ..... G07F 11/14 221/232
4,225,034 A * 9/1980 Sarovich ..... B65G 17/12 198/698
5,117,614 A * 6/1992 Johnsen ..... B65B 35/50 53/247
5,388,387 A * 2/1995 McElvy ..... B65B 9/207 242/421
6,112,539 A * 9/2000 Colberg ..... G07F 11/68 62/331
2003/0196411 A1* 10/2003 Schroeder ..... B65B 9/093 53/410
2005/0121099 A1* 6/2005 Hansen ..... B65B 9/087 141/10
2011/0185685 A1* 8/2011 Metzger ..... F25C 5/18 53/473
2011/0185749 A1* 8/2011 Metzger ..... F25C 5/20 62/62
2012/0070264 A1* 3/2012 Pape ..... B65G 69/0408 414/794.4
2015/0284192 A1* 10/2015 Hirschek ..... B65G 59/062 414/222.08

* cited by examiner

ICE BAGGING AND DISPENSING APPARATUS

CROSS-REFERENCE TO RELATED APPLICATIONS

This application claims the benefit of U.S. Provisional Application Ser. No. 62/607,804, filed on Dec. 19, 2017, which is incorporated herein by reference.

TECHNICAL FIELD

The present disclosure relates to packaged ice. More specifically, the present disclosure relates to an apparatus for the point-of-sale production of bagged ice.

BACKGROUND

The packaged ice industry has a retail value in the billions. Most packaged ice is produced in regional warehouses and delivered to freezers in retail locations up to a 100-mile radius from the point of manufacture. The transportation of ice is costly, and the energy consumed raises environmental concerns.

Attempts have been made to create point-of-sale automated ice manufacturing and bagging machines, but the complexity of these machines leads to high acquisition cost and maintenance problems. Most ice retailing freezers and systems do not follow first-in, first-out (FIFO) principles, leading to food safety concerns and inferior product due to time in the freezer.

One example in the prior art is shown in U.S. Pat. No. 8,122,689. This system drops ice bags from the top onto a pile in a storage and dispensing freezer, which consumers open and take bags off the pile. This is not inherently FIFO and precautions must be taken to avoid dropping ice onto consumers for safety reasons.

Another example in the prior art is shown in U.S. Pat. No. 8,468,784, which attempts to reduce the maintenance needs by having two rolls for bagging material and a system to automatically advance each roll in turn, thereby extending the interval between refilling bagging material. However, this system uses two bag advance systems, which may increase the cost of the system.

Therefore, a need exists for a point-of-sale automated ice maker and bagging system for retail dispensing or vending that incorporates FIFO delivery and that is simplistic in design for low acquisition and maintenance costs.

SUMMARY OF EXAMPLE EMBODIMENTS

In one embodiment, an ice bagging and dispensing apparatus comprises at least one ice making machine; an ice hopper for receiving ice from the at least one ice making machine; an ice bagging machine for bagging ice from the ice hopper; an ice bag conveyor for conveying bagged ice from the ice bagging machine to an ice storage chamber, the ice bag conveyor positioned below the ice storage chamber; a carriage on the conveyor for moving and lifting the bag of ice into the ice storage chamber; one or more supports for supporting one or more bags of ice in the ice storage chamber above the ice bag conveyor; and, one or more consumer access doors to the ice storage chamber.

In one embodiment, an ice bagging machine comprises one or more rolls of bag material and a material advance mechanism. The material advance mechanism may comprise rollers and/or conveyors to advance the material. Heat sealers are used to seal the material into bags, with blades or edges separating the material from the rolls. One or more vacuum suctions are used to open the bag material to receive ice. When the first roll of bag material is depleted, a second roll of bag material may be coupled to the end of the first roll (e.g., adhesives, heat sealed, stapled, etc.). The second roll of bag material is then advanced using the same material advance mechanism.

DETAILED DESCRIPTION OF EXAMPLE EMBODIMENTS

Figure 1:
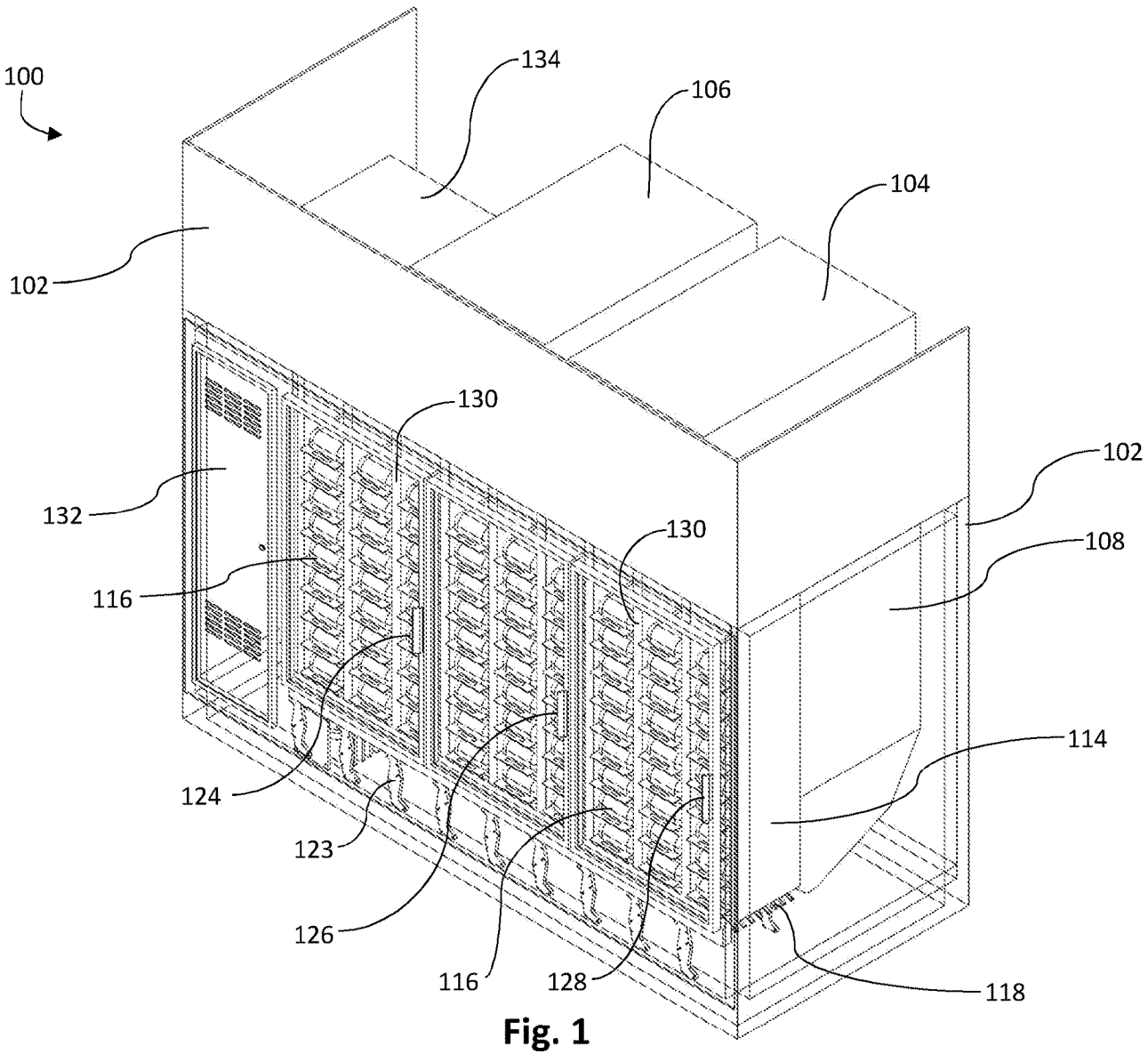
FIG. 1 is front, top perspective view of an ice bagging and dispensing apparatus.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a point-of-sale automated ice maker and bagging system for retail dispensing or vending with FIFO delivery, which is simplistic in design, and which allows for low acquisition and maintenance costs. The ice bagging and dispensing apparatus described below solves these, and other, problems.

In one embodiment, as shown generally in FIGS. 1-6, an ice bagging and dispensing apparatus 100 comprises a housing 102, at least one ice making machine 104, 106, an ice hopper 108, an ice bagging machine 110, an ice bag conveying system 112, and an ice storage chamber 114. The ice making machine 104, 106 may be of a common variety known in the art. Further, the ice hopper 108 may be of a common variety known in the art, and that preferably has an auger for moving the ice in the ice hopper 108 to the bagging machine 110. The bagging machine 110 will be described in detail later herein. Once the ice has progressed from the ice hopper 108 to the bagging machine 110, the resulting bagged ice 116 is received within the bag conveying system 112 and is ready for conveyance. The bag conveying system 112 may move the bagged ice 116 horizontally beneath the ice storage chamber 114 to the desired location for stacking. The bagged ice 116 may be conveyed via a conveyor belt, screw-drive and platform, chain drive, or any other similar mechanism for moving the bagged ice 116 horizontally beneath the ice storage chamber 114. In one embodiment, the bag conveying system 112 comprises a carriage 120 for holding and conveying the bagged ice 116, the carriage being directly conveyed using the mechanisms described above.

Figure 3:
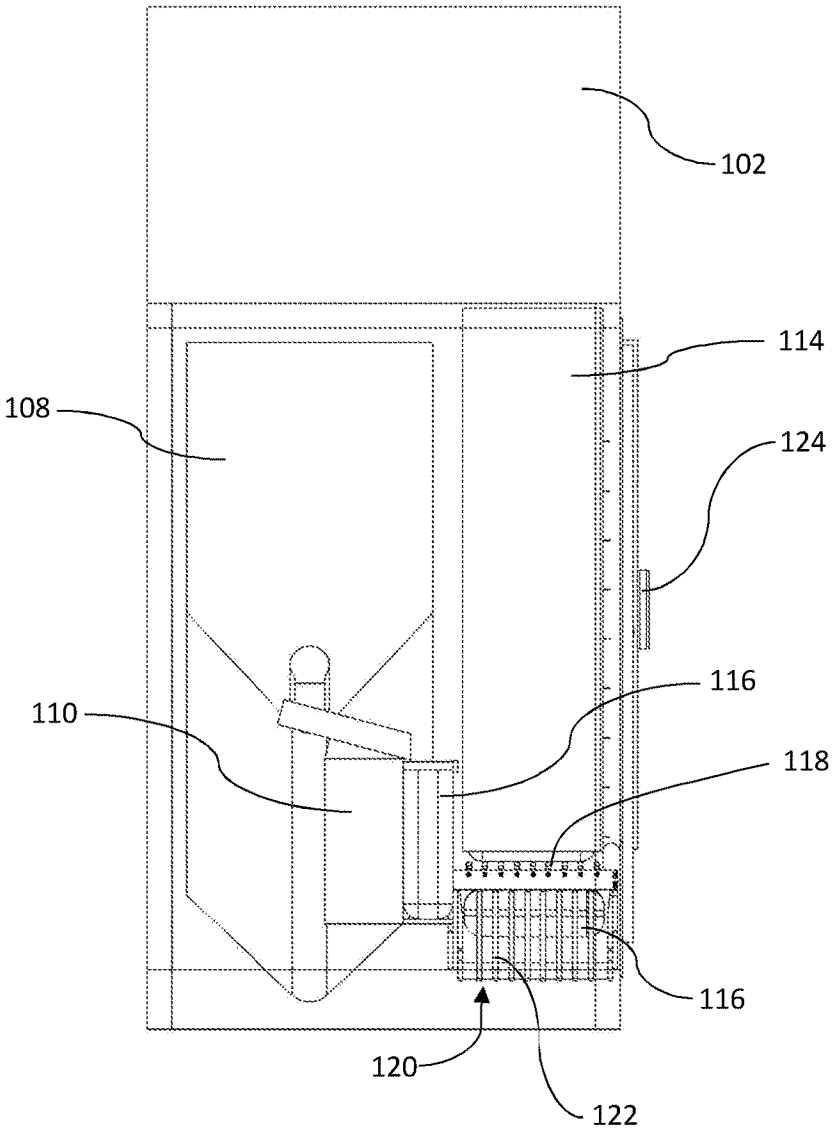
FIG. 3 is a left side elevation view of an ice bagging and dispensing apparatus.

As shown, the bagged ice 116 in the ice storage chamber 114 is held above the travel path of the conveyed bagged ice 116 using support fingers 118. Once the bagged ice 116 being conveyed has reached its destination, the bagged ice 116 is lifted using the carriage 120. The carriage 120 comprises a vertical actuator, which may be controlled using motors, screw drives, or the like. In one embodiment, as shown in FIG. 3, the carriage 120 may further comprise a plurality of lifting fins 122 for lifting the bagged ice 116 into the ice storage chamber 114. The lifting fins 122 are offset from the support fingers 118, which allows them to pass-through one another as the stack of bagged ice 116 is lowered onto the support fingers 118 after the carriage 120 has lifted. It will be appreciated that the orientation of the support fingers 118 may be altered while still achieving the same end result. Further, while support fingers 118 and lifting fins 122 are shown as examples, the present invention is not so limited. In other embodiments, rather than support fingers 118, a support platform may be used that retracts from beneath the stack. Accordingly, the entire stack of bagged ice 116 is then resting on the carriage 120. The carriage 120 then raises the stack past the support platform, whereupon the support platform then closes to support the stack. The support platform may have one or more apertures that allow for withdrawal of the components of the carriage 120 that were above the support platform when it closed. In one embodiment, the support platform is comprised of support fingers 118 that retract as the bagged ice is forced upward. The lifting fins 122 then lifts and holds the stack in position as the support fingers 118 then return to position under the stack of ice. The support fingers 118 may be staggered in relation to the lifting fins 122, allowing the stack of bagged ice 116 to rest on the support fingers 118 as the lifting fins 122 retract downward (sequentially or simultaneously) to return to position for accepting a new bag of ice.

Figure 4:
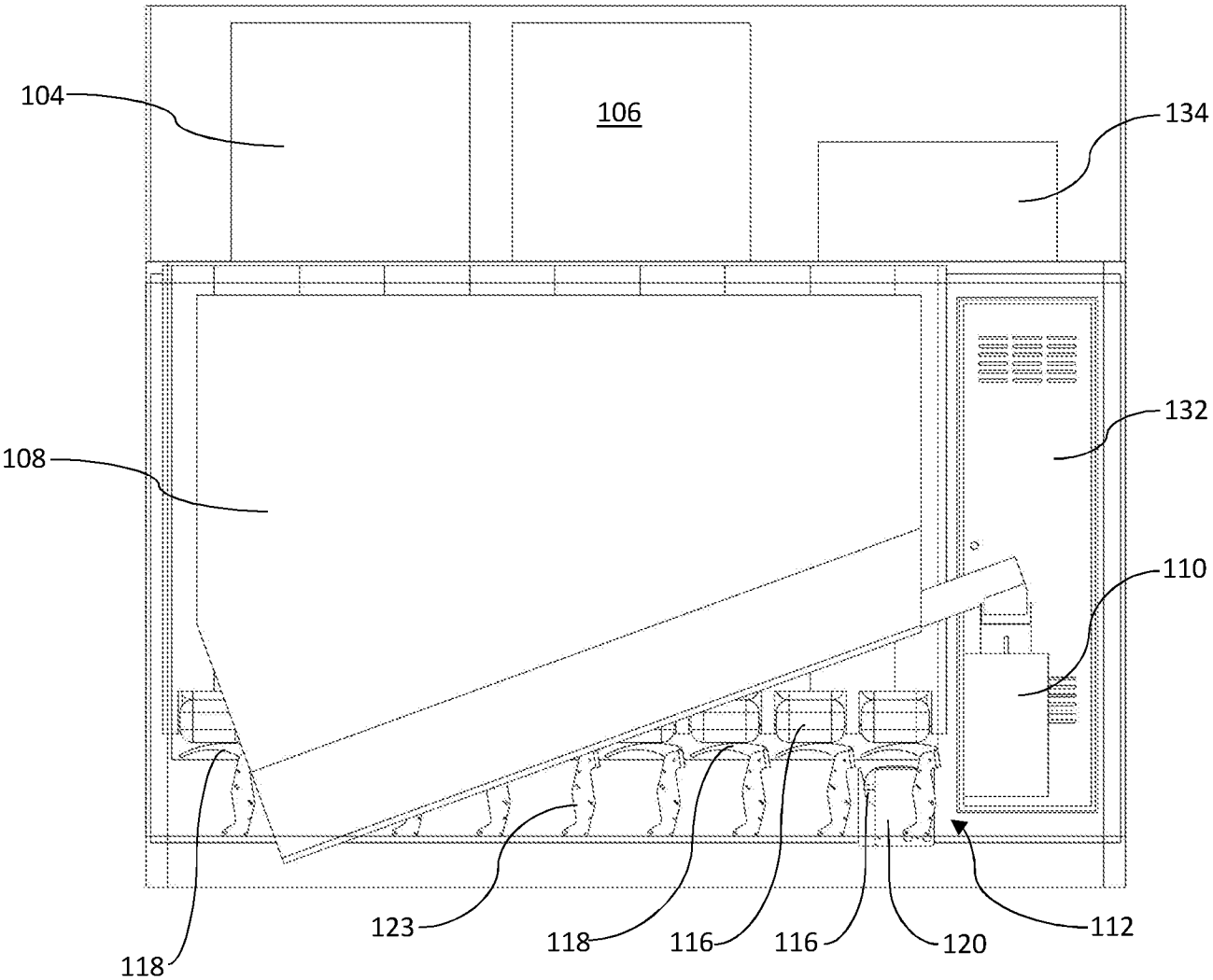
FIG. 4 is a rear elevation view of an ice bagging and dispensing apparatus.
Figure 5:
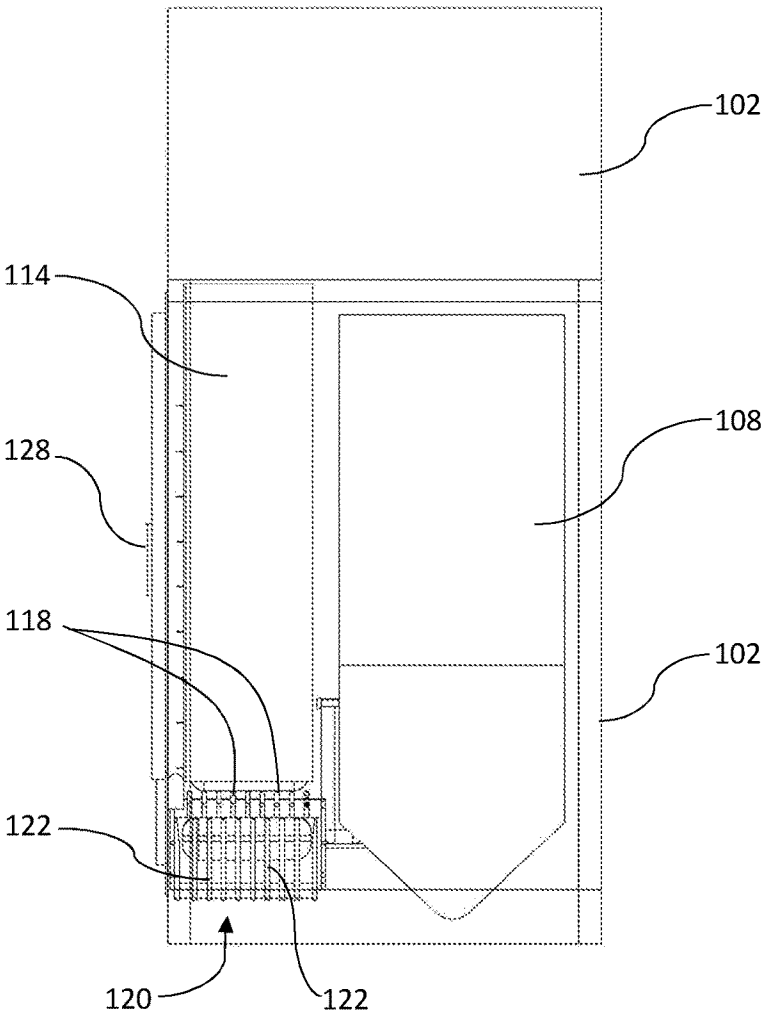
FIG. 5 is a right elevation view of an ice bagging and dispensing apparatus.

FIG. 4 shows a back view of the ice bagging and dispensing apparatus 100 and an example of a carriage 120 as part of the conveying system 112 to move the bagged ice 116 into position. In this embodiment, the carriage 120 moves from the ice bagging machine 110 to the various ice stacks and lifts the bagged ice 116 up while raising the stacks. The spaced lifting fins 122 may cradle the ice bags 116 to support their shape. Pivot arms 123 move the support fingers 118 aside as the ice bag 116 is lifted with the stack of bagged ice 116. These pivot arms 123 may be actuated by various means. For example, in one embodiment the motion of the carriage 120 being lifted actuates the pivot arm 123 by contact (for example a cam system), thus eliminating the need for individual actuators on each pivot arm 123. In another embodiment, the carriage 120 carries a separate actuator to move the pivot arms 123 independent of the lifting motion, while still eliminating the need for individual actuators on each pivot arm 123.

Figure 6:
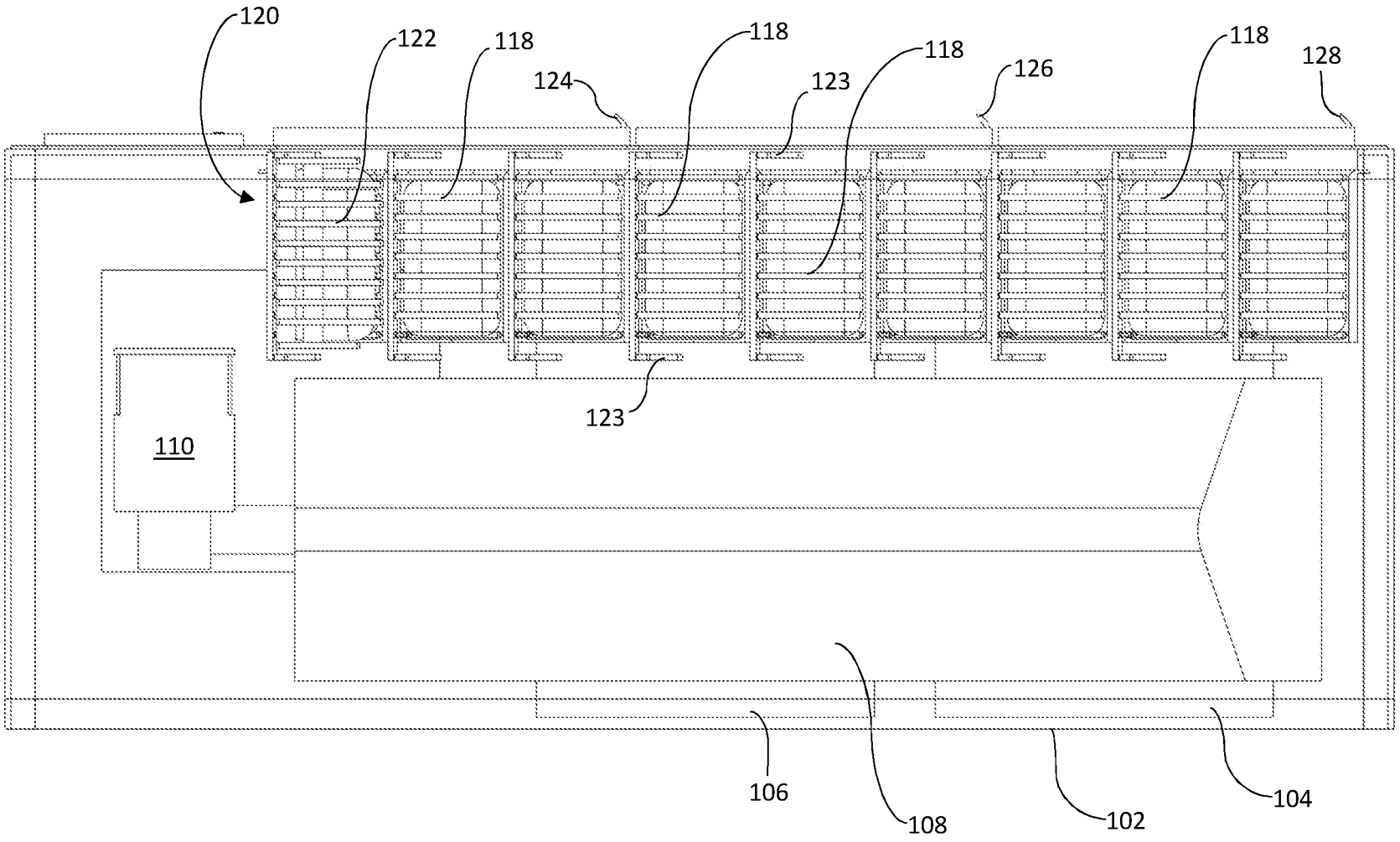
FIG. 6 is a bottom plan view of an ice bagging and dispensing apparatus.
Figure 7:
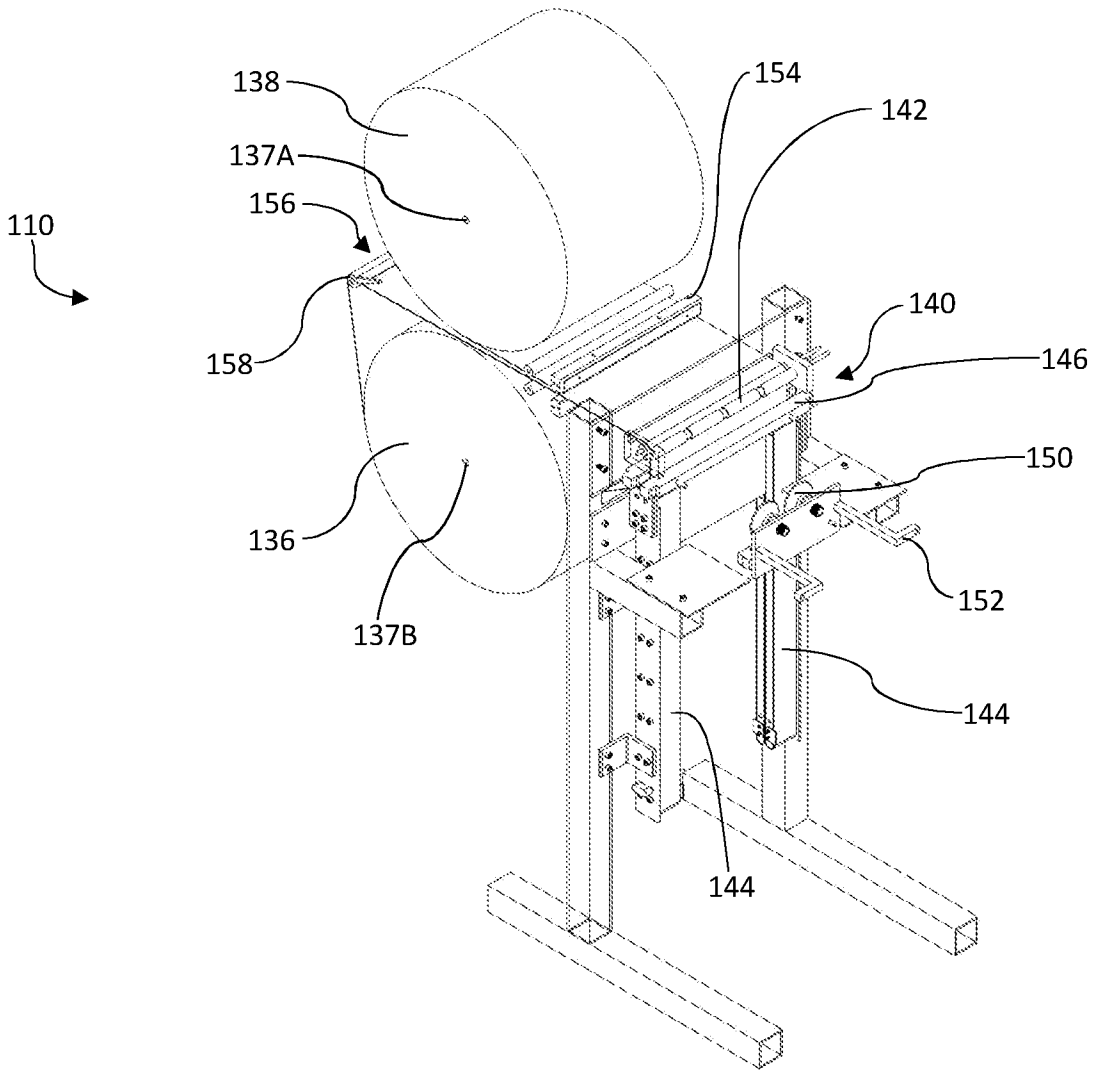
FIG. 7 is a front, top perspective view of a bagging machine of an ice bagging and dispensing apparatus.
Figure 8:
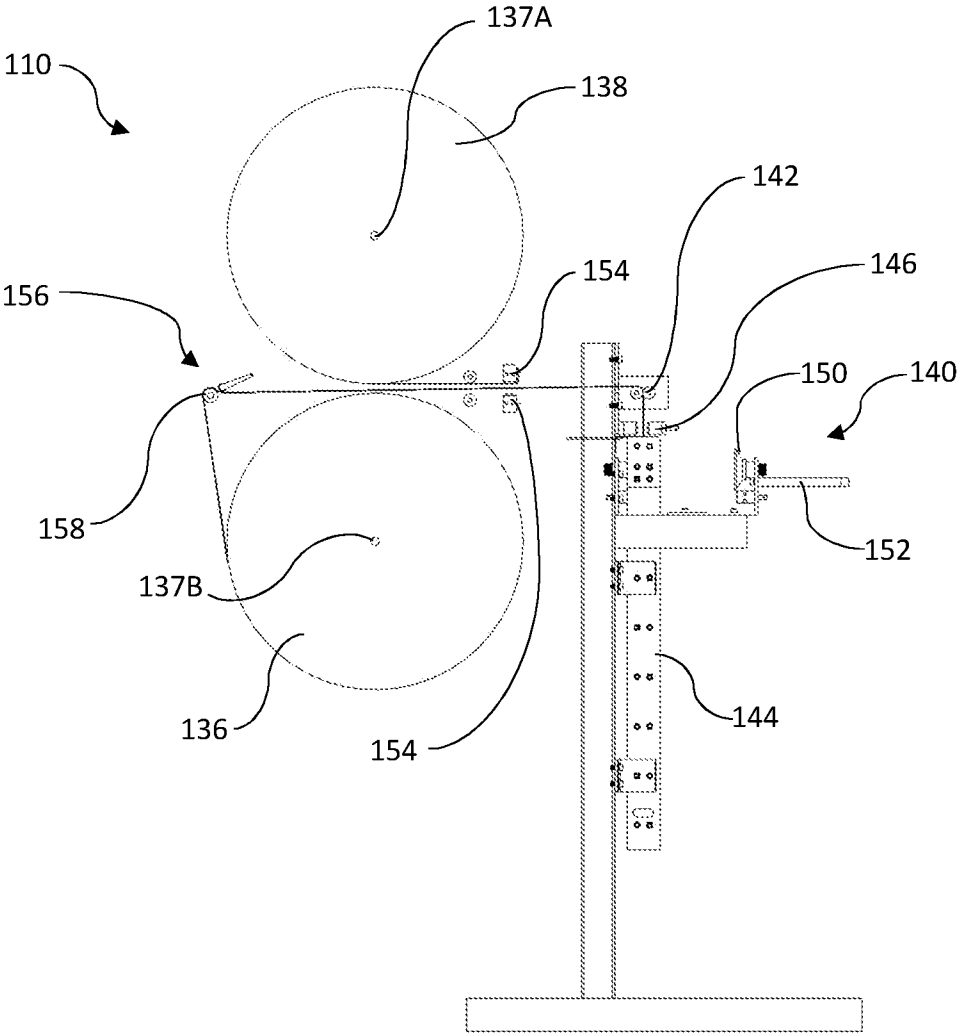
FIG. 8 is a left elevation view of a bagging machine of an ice bagging and dispensing apparatus.
Figure 9:
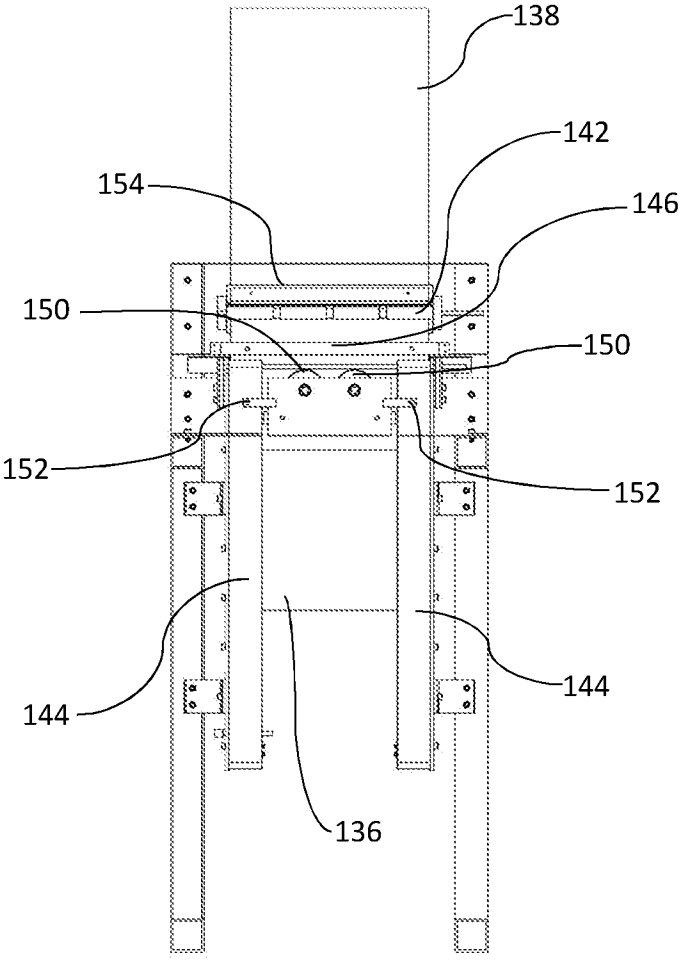
FIG. 9 is a front elevation view of a bagging machine of an ice bagging and dispensing apparatus.
Figure 10:
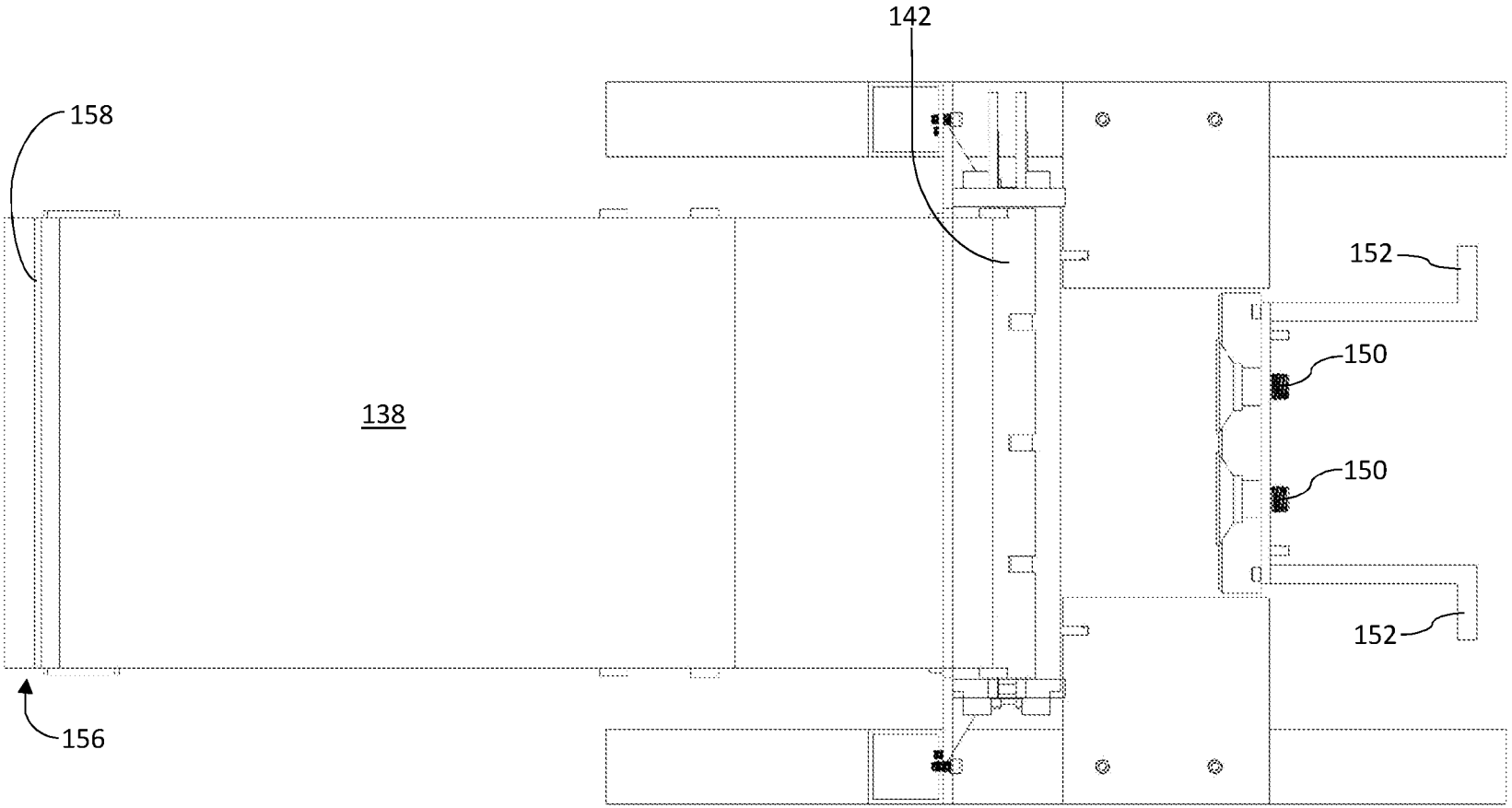
FIG. 10 is a top plan view of a bagging machine of an ice bagging and dispensing apparatus.

FIG. 6 shows a bottom view of the ice bagging and dispensing apparatus 100. In this embodiment, the lifting fins 122 and support fingers 118 are equally spaced and alternating in placement to allow the lifting fins 122 to ascend and descend through the support fingers 118.

As appreciated from the foregoing, the ice that was made and bagged first remains at the top of the stack. Accordingly, when a user opens the door 124, 126, 128 to access the ice storage chamber 114, the user will remove the top bag of ice 116, which is the oldest bagged ice 116. In other words, because the new bagged ice 116 is added to the bottom of the stack, they ice bagging and dispensing apparatus 100 herein is a first-in, first-out (FIFO) system. This keeps the bagged ice 116 in the ice storage chamber 114 fresh, without the need for worker intervention. This also means that the consumer is selecting a bag of ice 116 that has been in the freezer longer. In other words, the bags of ice 116 at the top of the stack are older than the bags of ice 116 at the bottom of the stack. As a result, the bagged ice 116 is much colder than the newer bag of ice 116 at the bottom that has been recently added to the stack from the hopper 108. This is beneficial to a user, as the older, colder ice will take longer to thaw. Further, a worker does not need to restock the bagged ice 116, and consumers need not worry about bagged ice 116 falling from above (prior art) which may cause injuries. Accordingly, it is apparent that the ice bagging and dispensing apparatus 100 has several benefits over the prior art.

Figure 2:
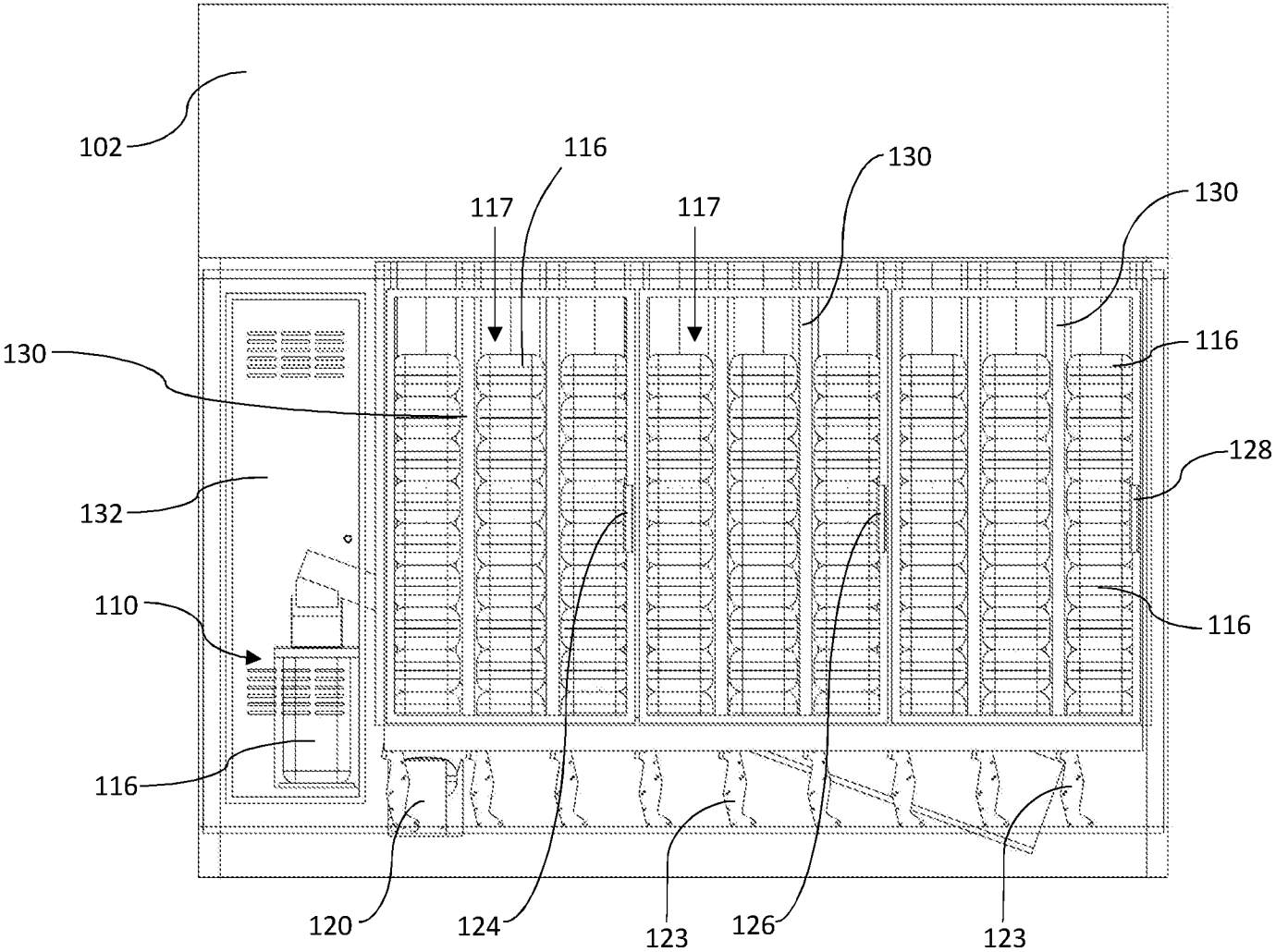
FIG. 2 is a front elevation view of an ice bagging and dispensing apparatus.

As best shown in FIGS. 1-2, the ice storage chamber 114 is separated into columns using dividers 130. This keeps the stacks 117 of bagged ice 116 from collapsing. It also allows for bagged ice 116 to be easily pushed up without the stack 117 of ice falling over. Further, one or more sensors may be used to determine which stack 117 is in need of ice. For example, weight sensors may be implemented with the support fingers 118, or infrared sensors may be used to determine height (e.g., stack is below the infrared light), or other mechanism for determining the ice level of each column. Further, the carriage 120 may be conveyed to the appropriate stack in need of ice. Again, this may be accomplished using sensors, coordinates, distances, or any other number of known methods in the art of conveying, combined with the conveying mechanism (e.g., belts, chains, screw-drives, wheels and motors, etc.).

An access door 132 allows a worker to access the ice bagging machine 110 to replenish the rolled bag material and to service the equipment. A refrigeration unit 134 keeps the ice storage chamber 114 at a temperature sufficient to keep the ice frozen. It will be appreciated that the location of the refrigeration unit 134 and ice maker 104, 106 may vary without departing herefrom.

FIGS. 7-11 show an embodiment of an ice bagging machine 110 and configuration to feed one or more rolls 136, 138 of bagging material. A single bag material advance mechanism 140 draws bag material from at least a first roll 136. The bag material advance mechanism 140 may comprise rollers 142 and/or conveyors 144 to draw bag material from the roll 136, 138.

Figure 11:
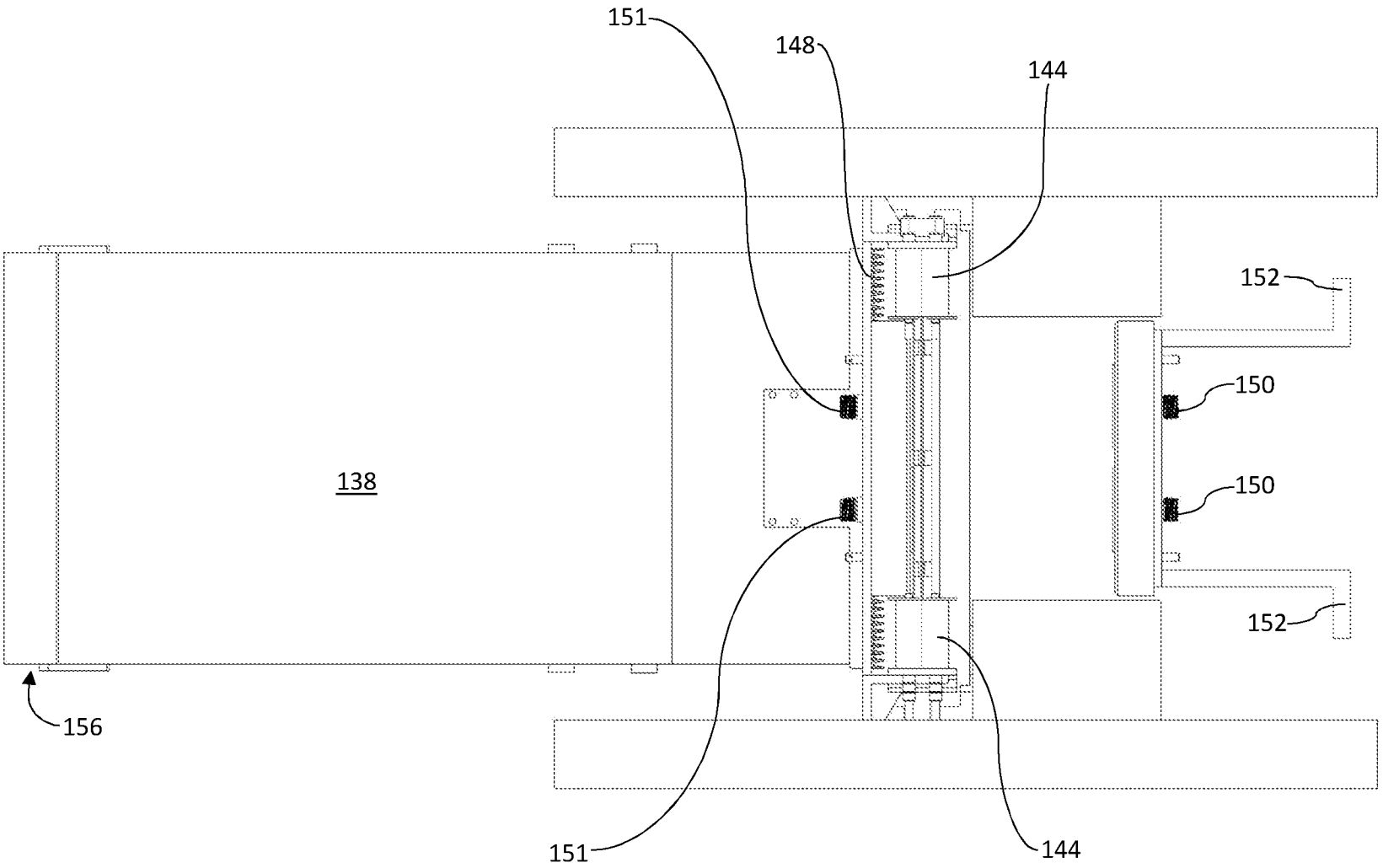
FIG. 11 is a bottom view of a bagging machine of an ice bagging and dispensing apparatus.

The bag material may be tubular film, folded film, or pre-opened bags. In one embodiment, bags are completed by heat-sealing one or more edges using heat sealer 146. Bags may be separated by many methods, such as cutting or tearing along pre-formed perforations using blades or edges 148 (FIG. 11). In one embodiment, the bags are opened by one or more vacuum cups 150 actuated on a slide mechanism 152 to allow ice to be dispensed into the bag. For example, as the bag material is advanced using the advance mechanism 140, the bag is heat-sealed on a first end using heat sealer 146, with the second end being separated from the roll 136, 138 using edges 148. The vacuum cups 150 are then pressed against the material to form a suction, with the vacuum cups 150 then moving rearwardly on slide mechanism 152 (e.g., horizontal rods). This opens the bag material so that it is ready to receive ice. After the bag is full of ice, the bag may be closed or sealed using sealer 146. If required, additional vacuum cups 151 (FIG. 11) may be used on the opposite side of the bag material so that the bag opens sufficiently.

When the first roll 136 of bag material is depleted, the beginning of an optional second roll 138 may be attached to the end of the first roll 136. For example, adhesive may be applied, or staples, or by heat-sealing them together, such as by using heat sealers 154. Thus, the second roll 138 of bag material begins to be drawn by the single bag material advance mechanism 140. This allows more than one full roll 136, 138 of bag material to be used between refilling. It also allows refilling at any time without discarding a partial roll.

In this way two or more rolls 136, 138 can be used. A new bag roll 136, 138 can be placed on any roll spindle 137A, 137B, and any roll spindle 137A, 137B can be the currently-feeding roll with subsequent rolls (or multiple rolls) in any other position.

In order to detect when a roll 136, 138 is reaching the end, rotary encoders or sensors may be used. In one embodiment back-tension on the advancing bag material is provided by a drag mechanism 156 providing resistance to rotation of the roll 136, 138. This keeps the bag material tight on the roll 136, 138 and aids in sensing the end of a roll 136, 138. For example, a rotary encoder on a roll 136, 138 could be used to detect when the bag roll 136, 138 ends and the roll 136, 138 stops rotating with advancing bag material.

In one embodiment, when the roll 136, 138 nears the end of the bag material, the back tension is lost on drag mechanism 156 and the force changes on the sensing roller 158. There are many ways the sensing roller 158 can detect the change. For example, the sensing roller 158 may move in response to the change in tension, thereby causing a sensor or switch to change state, or a senor may directly detect the change in force on the roller 158. Alternatively, the sensing roller 158 may have an encoder to detect rotation and the cessation of the roller rotation is sensed at the end of the roll 136, 138. Therefore, in one method of use, a user may install a first roll 136 of bag material and a second roll of bag material 138. The single bag material advance mechanism 140 advances the bag material from roll 136. As the roll 136 nears depletion, the first end of the second roll 138 is coupled to the last end of the bag material from roll 136 (e.g., heat-sealed together). The single bag material advance mechanism 140 then proceeds to advance the bag material from the second roll 138. While the second roll 138 is advancing, a user may add a new roll 136 to the first spindle. This allows the bagging apparatus 110 to proceed making bags without interruption. In the alternative, a user may opt to let both rolls 136, 138 deplete before replenishing. As a result, the time between bag material replenishment is doubled.

From the foregoing disclosure, it will be appreciated that the ice bagging and dispensing apparatus 100 disclosed herein achieves FIFO delivery by forcing new bagged ice up from the bottom—something that has never been achieved by the prior art. Accordingly, a method of bagging and dispensing ice using first-in, first-out principles comprises feeding ice into an ice bagging machine to form bagged ice, conveying the bagged ice beneath an ice storage chamber, and then forcing the bagged ice upward into the storage chamber so that the most recent bagged ice is at the bottom of the stack of bagged ice within the ice storage chamber.

As appreciated from the foregoing, the ice bagging and dispensing apparatus disclosed herein solves the need for a point-of-sale automated ice maker and bagging system for retail dispensing or vending with FIFO delivery, which is simplistic in design, and which allows for low acquisition and maintenance costs.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. An ice bagging and dispensing apparatus, comprising:

at least one ice making machine;

an ice hopper for receiving ice from the at least one ice making machine;

an ice bagging apparatus for bagging ice from the ice hopper;

a carriage positioned beneath the ice bagging apparatus to receive the bagged ice, the carriage comprising a plurality of lifting fins;

an ice bag conveyor extending horizontally from beneath the ice bagging apparatus to the end of an ice storage chamber, the ice bag conveyor configured to convey the carriage having the bagged ice therein from the ice bagging apparatus to the ice storage chamber;

the ice storage chamber comprising a plurality of dividers forming a plurality of columns, each column comprising a plurality of support fingers at a first, bottom end, supporting a stack of bagged ice above the conveyor; and one or more consumer access doors to each column of the ice storage chamber.

2. The ice bagging and dispensing apparatus of claim 1, wherein the ice bagging apparatus comprises:

two spindles, each configured to receive a roll of bag material, respectively;

rollers or conveyors configured to advance the roll of bag material from each spindle consecutively, wherein a first heat sealer is configured to seal the end of the first roll of bag material to the beginning of the second roll of bag material;

one or more vacuum cups configured to open the bag material; and a second heat sealer configured to seal the bag material into formed bags.

* * * * *